US008292689B2

(12) United States Patent
Hardin et al.

(10) Patent No.: US 8,292,689 B2
(45) **Date of Patent: *Oct. 23, 2012**

(54) ELECTRONIC PLAYSET

(75) Inventors: Mark Hardin, Hermosa Beach, CA (US); Andy Chan, Kowloon (HK); Eric Skifstrom, Manhattan Beach, CA (US); Jack Millerick, San Jose, CA (US)

(73) Assignee: Mattel, Inc., El Segundo, CA (US)

( * ) Notice: Subject to any disclaimer, the term of this patent is extended or adjusted under 35 U.S.C. 154(b) by 1414 days.

This patent is subject to a terminal disclaimer.

(21) Appl. No.: 11/865,620

(22) Filed: Oct. 1, 2007

(65) Prior Publication Data

US 2008/0113586 A1 May 15, 2008

Related U.S. Application Data

(60) Provisional application No. 60/849,338, filed on Oct. 2, 2006.

(51) Int. Cl.
*A63F 3/52* (2006.01)

(52) U.S. Cl. ..... 446/477; 446/479

(58) Field of Classification Search ..... 446/175
See application file for complete search history.

(56) References Cited

U.S. PATENT DOCUMENTS

| | | | | |
|---|---|---|---|---|
| 3,182,420 | A | | 5/1965 | Bender |
| 4,398,723 | A | | 8/1983 | Erickson et al. |
| 4,421,317 | A | | 12/1983 | Hector et al. |
| 4,432,151 | A | | 2/1984 | Morris |
| 5,013,278 | A | | 5/1991 | Dixon et al. |
| 5,022,682 | A | * | 6/1991 | Desmond ..... 281/38 |
| 5,055,083 | A | | 10/1991 | Walker |
| 5,085,609 | A | | 2/1992 | Haberle |
| 5,278,779 | A | | 1/1994 | Conway et al. |
| 5,280,416 | A | * | 1/1994 | Hartley et al. ..... 362/98 |
| 5,312,284 | A | | 5/1994 | Grober et al. |
| 5,445,552 | A | | 8/1995 | Hine |
| 5,513,129 | A | | 4/1996 | Bolas et al. |

(Continued)

FOREIGN PATENT DOCUMENTS

EP 0978301 2/2000

(Continued)

OTHER PUBLICATIONS

An International Search Report and Written Opinion of the International Searching Authority from International Application No. PCT/US07/80215.

*Primary Examiner* — Tramar Harper
(74) *Attorney, Agent, or Firm* — Kolisch Hartwell, PC

(57) ABSTRACT

The present disclosure provides for electronic playsets and components thereof. An electronic playset of the present disclosure may include a see-through monitor having a transparent screen configured to display an animated image superimposed over one or more regions. The see-through monitor may be moveable by rotation or translation between one or more positions, the one or more positions being adjacent to the one or more regions. Some embodiments including a see-through monitor with a light source configured to illuminate the one or more regions. Another aspect of the present disclosure provides for a removable toy having an identifiable accessory that may be provided to an electronic playset. The playset may be configured to identify the toy and display an animated character based on the identity.

19 Claims, 6 Drawing Sheets

U.S. PATENT DOCUMENTS 5,655,945 A 8/1997 Jani
5,728,962 A 3/1998 Goede
RE35,819 E 6/1998 Suzuki
5,766,077 A 6/1998 Hongo
5,940,167 A 8/1999 Gans
5,952,598 A 9/1999 Goede
5,966,526 A 10/1999 Yokoi
5,971,833 A 10/1999 Rasmussen
5,989,033 A * 11/1999 Burgio ..... 434/88
6,039,625 A 3/2000 Wang
6,048,251 A 4/2000 Klitsner
6,056,618 A 5/2000 Larian
6,165,068 A 12/2000 Sonoda et al.
6,190,174 B1 2/2001 Lam
6,192,215 B1 2/2001 Wang
6,213,871 B1 4/2001 Yokoi
6,227,931 B1 5/2001 Shackelford
6,227,966 B1 5/2001 Yokoi
6,273,815 B1 8/2001 Stuckman et al.
6,290,565 B1 9/2001 Galyean et al.
6,302,612 B1 10/2001 Fowler et al.
6,319,010 B1 11/2001 Kikinis
6,319,130 B1 11/2001 Ooseki et al.
6,343,006 B1 1/2002 Moscovitch et al.
6,353,170 B1 3/2002 Eyzaguirre et al.
6,369,822 B1 4/2002 Peevers et al.
6,443,796 B1 * 9/2002 Shackelford ..... 446/91
6,449,518 B1 9/2002 Yokoo et al.
6,461,238 B1 10/2002 Rehkemper et al.
6,500,070 B1 12/2002 Tomizawa et al.
6,537,149 B2 3/2003 Sogabe
6,542,869 B1 4/2003 Foote
6,558,225 B1 5/2003 Rehkemper et al.
6,609,968 B1 8/2003 Okada et al.
6,652,383 B1 11/2003 Sonoda et al.
6,656,049 B1 12/2003 Masaki
6,722,973 B2 4/2004 Akaishi
6,773,325 B1 8/2004 Mawle et al.
6,800,013 B2 10/2004 Liu
6,814,662 B2 11/2004 Sasaki et al.
6,832,955 B2 12/2004 Yokoi
6,885,898 B1 4/2005 Brown et al.
6,898,759 B1 5/2005 Terada et al.
6,937,152 B2 8/2005 Small
6,988,896 B2 1/2006 Cho
6,997,773 B1 2/2006 Dubois et al.
7,001,270 B2 2/2006 Taub
7,024,255 B1 4/2006 Brown et al.
7,059,934 B2 6/2006 Whitehead
7,081,033 B1 7/2006 Mawle et al.
7,095,387 B2 * 8/2006 Lee et al. ..... 345/4
7,104,884 B2 9/2006 Yokoi
7,203,558 B2 4/2007 Sugiyama et al.
7,254,455 B2 8/2007 Moulios
2002/0132553 A1 9/2002 Jelinek
2003/0064685 A1 4/2003 Kim
2003/0124954 A1 7/2003 Liu
2004/0004667 A1 1/2004 Morikawa et al.
2004/0133354 A1 7/2004 Low et al.
2004/0197758 A1 * 10/2004 Langford ..... 434/317
2004/0259635 A1 12/2004 Germeraad
2005/0009443 A1 1/2005 Martin et al.
2005/0024313 A1 2/2005 Nakajima et al.
2005/0054440 A1 3/2005 Anderson
2005/0237701 A1 10/2005 Yu
2005/0245302 A1 11/2005 Bathiche
2005/0253775 A1 11/2005 Stewart
2006/0007644 A1 1/2006 Huilgol et al.
2006/0009121 A1 1/2006 Rotundo
2006/0058101 A1 3/2006 Rigopulos
2006/0077621 A1 4/2006 Adatia
2006/0082518 A1 4/2006 Ram
2006/0126284 A1 6/2006 Moscovitch
2006/0160588 A1 * 7/2006 Yamada et al. ..... 463/1
2006/0172787 A1 8/2006 Ellis
2006/0181537 A1 8/2006 Vasan
2006/0266200 A1 11/2006 Goodwin

FOREIGN PATENT DOCUMENTS

EP 1365386 11/2003
GB 2425730 11/2006
JP 64091188 4/1989
JP 1315791 12/1989
JP 63170697 1/1990
JP 2006198017 8/2006
WO WO9422128 9/1994
WO WO9503588 2/1995
WO WO9525312 9/1995
WO WO0014719 3/2000
WO WO2006034180 3/2006

* cited by examiner

ELECTRONIC PLAYSET

CROSS REFERENCE TO RELATED APPLICATIONS

This application claims priority under 35 U.S.C. §119(e) to U.S. Provisional Patent Application No. 60/849,338 entitled "Video Toy with Backgrounds and Movable Screen," filed Oct. 2, 2006, the disclosure of which is incorporated herein by reference.

BACKGROUND

Some playsets include electronic displays configured to display animated images. Other playsets include one or more removable toys with identifiable accessories, wherein the playset may be configured to determine an identity of a removable toy by interacting with the removable toy's identifiable accessory.

Games and toys incorporating electronic displays or toys with identifiable accessories are found in U.S. Pat. Nos. 5,085,609; 5,278,779; 5,766,077; 6,039,625; 6,190,174; 6,192,215; 6,227,931; 6,302,612; 6,461,238; 6,773,325; 6,814,662; and 6,937,152; and U.S. Published Patent Application No. 2002/132553, the disclosures of which are incorporated herein by reference for all purposes.

SUMMARY OF THE DISCLOSURE

The present disclosure provides for electronic playsets and components thereof. An electronic playset of the present disclosure may include a see-through monitor having a transparent screen configured to display an animated image superimposed over one or more regions. The see-through monitor may be moveable by rotation or translation between one or more positions, the one or more positions being adjacent to the one or more regions. Some embodiments include a see-through monitor with a light source configured to illuminate the one or more regions. Another aspect of the present disclosure provides for a removable toy having an identifiable accessory that may be read by an electronic playset. The playset may be configured to identify the toy and display an animated character based on the identity.

DETAILED DESCRIPTION OF VARIOUS EMBODIMENTS

Figure 1:
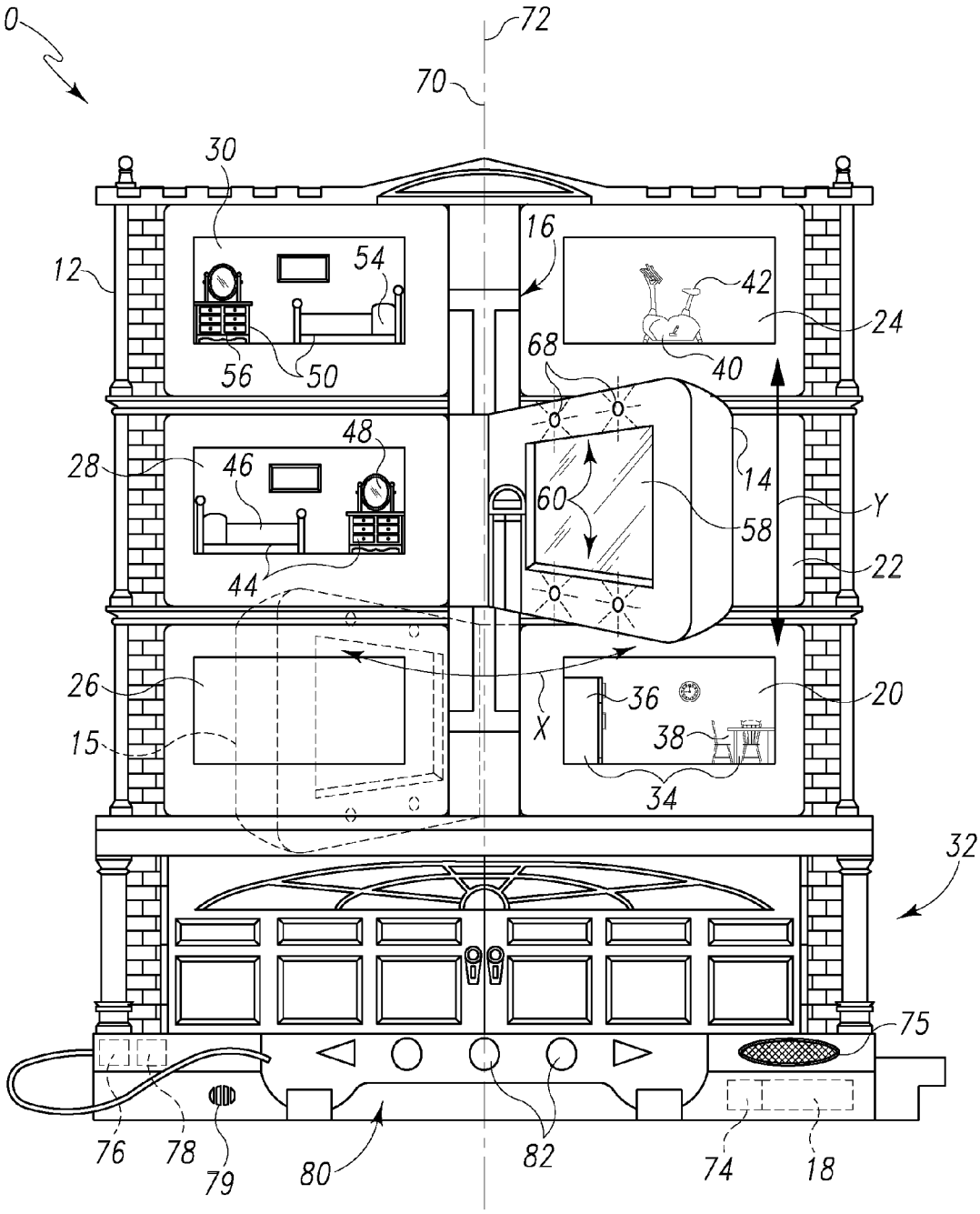
FIG. 1 depicts an example playset including a housing and a see-through monitor with a transparent screen.
Figure 2A:
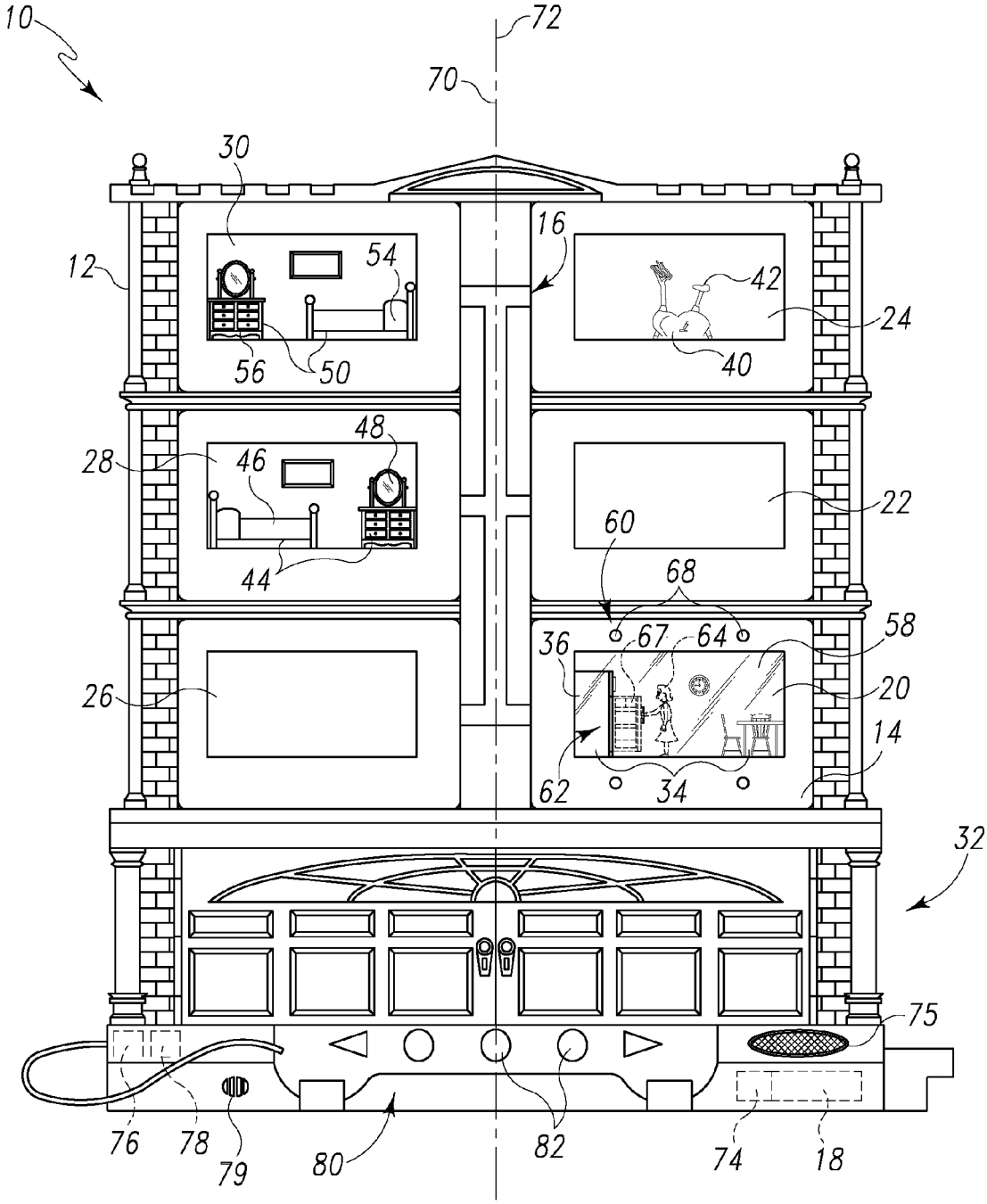
FIGS. 2A and 2B depict the playset of claim 1 with the see-through monitor in positions adjacent to two different regions and the transparent screen displaying an animated image superimposed over the two regions.
Figure 2B:
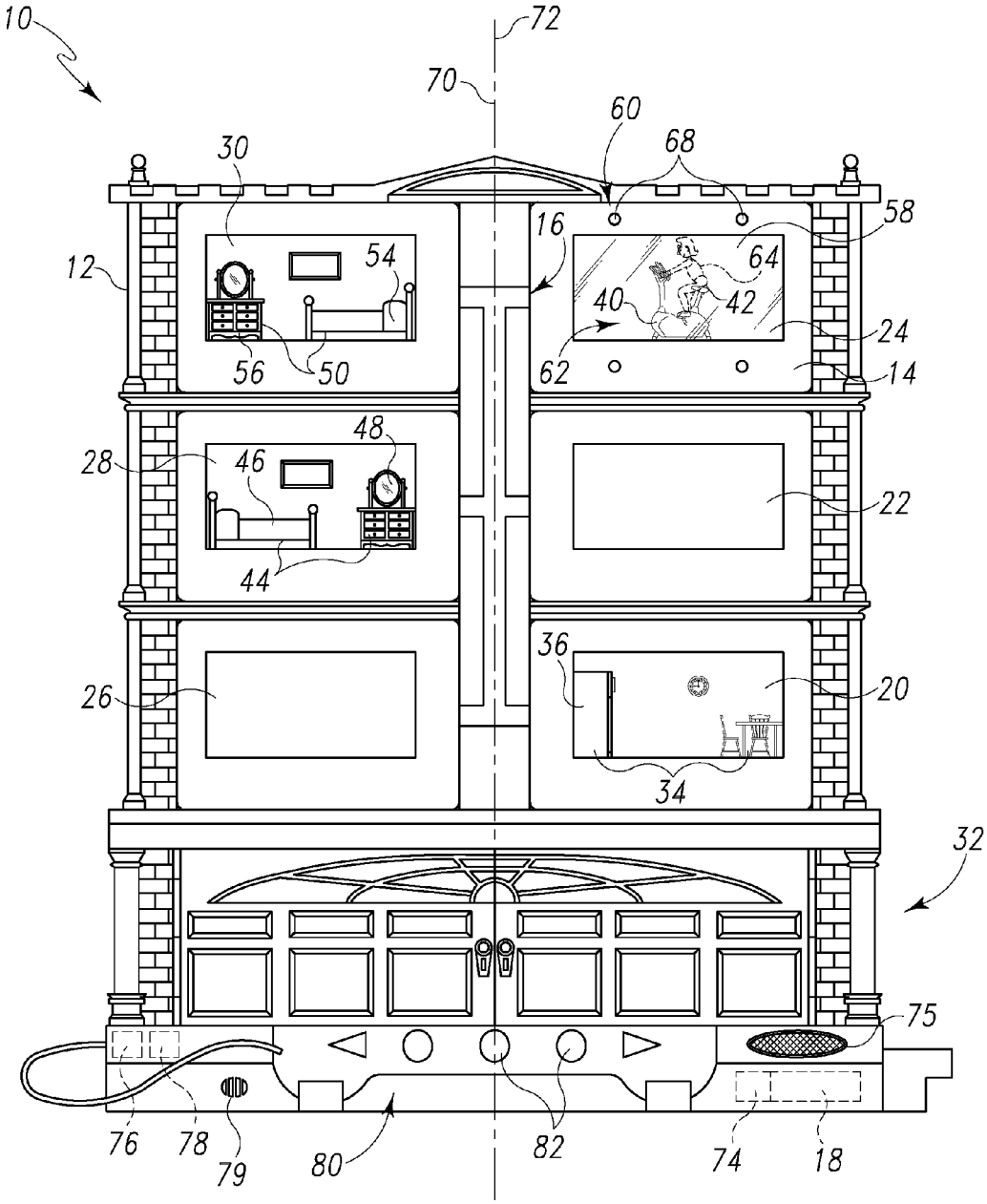

An electronic playset 10 in accordance with the present disclosure is described herein. Referring primarily to FIGS. 1, 2A and 2B, electronic playset 10 may include a housing 12, a see-through monitor 14, a mount 16, and a processor 18. Mount 16 may be disposed on housing 12. See-through monitor 14 may be coupled to mount 16 so that see-through monitor 14 may be rotated around or translated along mount 16, as will be discussed further below.

Housing 12 may comprise one or more regions, such as a first region 20, a second region 22, a third region 24, a fourth region 26, a fifth region 28 and a sixth region 30, so that housing 12 may resemble a multi-unit housing complex or a multi-room building. Each region may comprise a two-dimensional or three-dimensional scene. In some embodiments, such as the embodiment shown in FIGS. 1, 2A and 2B, housing 12 includes two or more three-dimensional regions. Three-dimensional regions may alternatively be referred to as "dioramas". In some embodiments, housing may further comprise a receiving area 32, which will be discussed in further detail below.

First region 20 of FIGS. 1, 2A and 2B comprises a diorama including one or more three-dimensional objects 34 such as a refrigerator 36 or a table and chairs 38. Third region 24 is shown including one or more three-dimensional objects 40 such as a stationary bicycle 42. Fifth region 28 includes one or more three-dimensional objects 44 such as a first bed 46 and a first dresser 48. Similar to fifth region 28, sixth region 30 includes one or more three-dimensional objects 50 such as a second bed 54 and a second dresser 56.

As seen best in FIG. 1, see-through monitor 14 may be coupled to mount 16 so that see-through monitor 14 may be both rotated around (shown by arrow X) and translated along (shown by arrow Y) the mount 16 between various positions, such as a first position adjacent to first region 20, a second position adjacent to second region 22, and a third position adjacent to third region 24. In other embodiments, such as the one depicted in FIGS. 1, 2A and 2B, see-through monitor 14 may similarly be moved to further positions adjacent to more regions, such as fourth region 26, fifth region 28 and sixth region 30. In yet other embodiments which only include first region 20 and second region 22, see-through monitor 14 may be moved between a first position adjacent to first region 20 and a second position adjacent to second region 22.

See-through monitor 14 may include a transparent screen 58 and a light source 60. Transparent screen 58 may be configured to display an animated image 62 superimposed over the various regions when see-through monitor 14 is in the corresponding positions. For instance, see-through monitor 14 may be configured to display an animated image 62 containing particular virtual objects and/or characters superimposed over first region 20 when see-through monitor 14 is in the first position, as shown in FIG. 2A. Likewise, see-through monitor 14 may be configured to display animated image 62 including the same or different virtual objects and/or characters superimposed over third region 24 when see-through monitor 14 is in the third position, as shown in FIG. 2B.

Animated image 62 may include one or more virtual characters and/or objects displayed superimposed over the regions. Further, animated image 62 may include virtual characters appearing to interact with objects in the various regions, such as three-dimensional objects 34, 40, 44 and 50. For instance, in FIG. 2A, animated image 62 includes a first virtual character 64 appearing to interact with refrigerator 36 by interacting with a virtual object 67 such as a virtual refrigerator door. In another instance shown in FIG. 2B, when see-through monitor 14 is in the third position adjacent to third region 24, transparent screen 58 may display animated image 62 including first virtual character 64 appearing to "ride" the stationary bicycle 42. Other virtual characters different from first virtual character 64 may be shown over various regions as well.

Light source 60 may be disposed on see-through monitor 14 and configured to illuminate the various regions when in the corresponding positions. For instance, the light source 60 may be configured to illuminate first region 20 when see-through monitor 14 is in a first position adjacent to first region 20, and to illuminate second region 22 when see-through monitor 14 is in a second position adjacent to second region 22. Light source 60 may include one or more light-emitting diodes 68, as well as other forms of light such as incandescent light bulbs.

Mount 16 may take various forms. In some embodiments, mount 16 may be elongate and linear so as to define an axis 70, such as the vertical axis 72 depicted in FIGS. 1, 2A and 2B. Axis 70 may be aligned to other angles as well. Axis 70 may also take a non-linear shape, such as a curve or other serpentine shapes.

Regions may be at various positions on the housing relative to an axis 70. For instance, FIGS. 1, 2A and 2B show first region 20 positioned on one side of vertical axis 72 and fourth 26, fifth 28 and sixth 30 regions positioned on the opposite side of vertical axis 72. In embodiments with three regions, first region 20 may positioned on one side of axis 70 and second 22 and third 24 regions may be positioned on the opposite side of axis 70.

Figure 3:
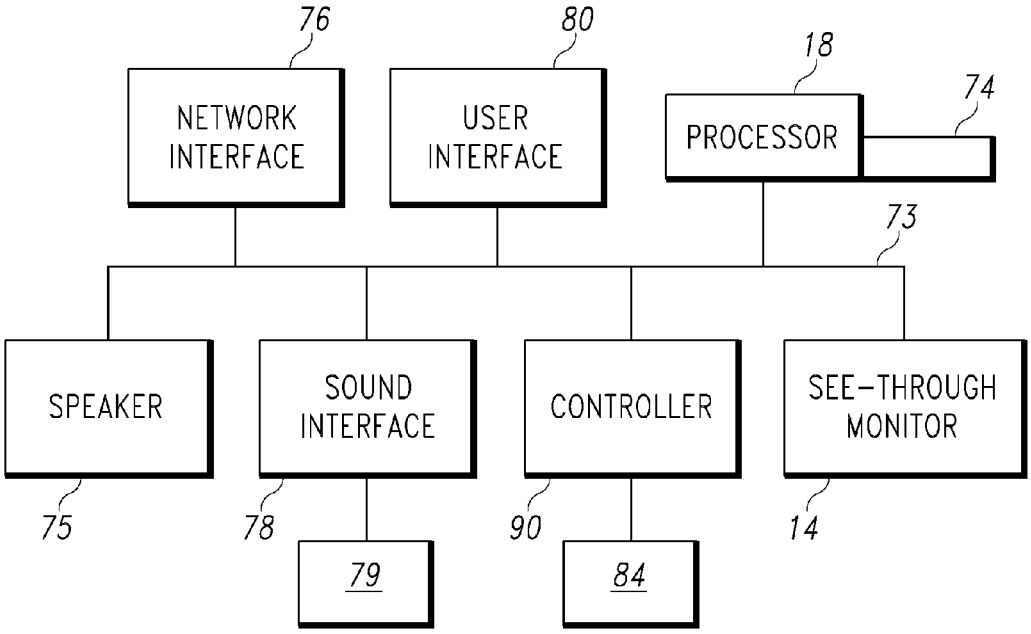
FIG. 3 depicts a schematic diagram illustrating one possible arrangement of various components of the playset.

Processor 18 may be a microprocessor such as those commonly found in various electronic components. As the example schematic diagram depicted in FIG. 3 shows, processor 18 may be operably connected (e.g., via bus 73) to other components included with housing 12, such as memory 74, a speaker 75, a network interface 76, a sound interface 78, a microphone 79, a user interface 80, and see-through monitor 14. Processor 18 may interact with each of these components, as will be described further below.

Processor 18 may be configured to execute instructions in memory 74 causing transparent screen 58 to display various animated images 62, including virtual characters such as those described above. Some virtual characters may be stored locally in memory 74. Other virtual characters may be associated with removable objects that may be connected to housing 12, as will be discussed in more detail below. Other virtual characters may be stored in memory 74, but may be unlocked when a particular removable object (described below) is affixed to housing 12.

Processor 18 further may be configured to determine which position see-through monitor 14 is in, so that processor 18 may instruct transparent screen 58 to display an animated image 62 appropriate for the corresponding region. In the example shown in FIG. 2A, see-through monitor 14 is in a first position adjacent to first region 20, which resembles a kitchen. Thus, processor 18 may instruct transparent screen 58 to display animated image 62 including first virtual character 64 appearing to open the door of refrigerator 36.

Likewise, when see-through monitor 14 is in a third position adjacent to third region 24, which resembles an exercise room, processor 18 may instruct transparent screen 58 to display a virtual character such as first virtual character 64 appearing to ride the stationary bicycle 42.

In some embodiments, virtual characters may be associated with particular regions. For instance, fifth region 28 may include items with masculine appearances, indicating that fifth region 28 may be a male's room. In such a case, when see-through monitor 14 is in a fifth position adjacent to fifth region 28, transparent screen 58 may be configured to display a male-appearing virtual character interacting with three-dimensional objects 44 in fifth region.

Likewise, sixth region 30 may include items with feminine appearances, indicating that sixth region 30 may be a female's room. In such a case, when see-through monitor 14 is in a sixth position adjacent to sixth region 30, transparent screen 58 may be configured to display a female-appearing virtual character interacting with three-dimensional objects 50 in sixth region.

It should be understood that virtual characters are not limited to a particular region, and virtual characters such as first virtual character 64 may be displayed by transparent screen 58 in multiple regions. Moreover, more than one virtual character may appear in a region at one time, and two or more virtual characters may appear to interact with each other, as well as the three-dimensional objects in the region.

Memory 74 may be used to store sounds, games, play modes, one or more animated images 62 including one or more virtual characters. Memory 74 may further be used to store real-time characteristics associated with a particular virtual character. For instance, as a user controls a virtual character over time, the user may be able to save the character as the character changes (e.g., becomes smarter or older). Additionally and/or alternatively, a virtual character's interactions with other virtual characters may be stored in memory 74, so that such interactions may affect further interactions between the two virtual characters or other virtual characters.

Processor 18 may further control other components. For instance, in embodiments including light source 60, processor 18 may execute instructions in memory 74 causing light source 60 to illuminate specific regions, as described above.

Electronic playset 10 may be configured with one or more speakers 75 which processor 18 may cause to produce sounds. Sounds may include music and/or sound effects to accompany various actions occurring in animated image 62. Sounds may further be controlled by a user operating user interface 80.

Network interface 76 may allow electronic playset 10 to connect to one or more computers directly or over a network (e.g., a local-area network or the Internet). Such a connection may be wireless (e.g., IEEE 802.x) or wired (e.g., Ethernet, parallel, serial, token ring, dial-up, etc.). Processor 18 may control network interface 76 to download information into memory 74. Such information may include new virtual characters to display on transparent screen 58, rules for new games a user may play, sounds to be produced from speaker 75, and the like.

Sound interface 78 may allow electronic playset 10 to receive acoustic signals. In some embodiments, sounds are received via acoustic wire. In other embodiments, sound waves may be received from a different medium, such as air (e.g., via microphone 79). The received signals may contain instructions and/or data which may be stored in memory 74. Processor 18 may be configured to instruct transparent screen 58 to display animated images 62 which respond to or are controlled by sounds received at sound interface 78.

User interface 80 may include one or more actuators 82 (e.g., buttons). The one or more actuators 82 may be operably connected to processor 18 so that they may be used to control various components such as animated image 62, light source 60 and/or speaker 75. In some embodiments, a user may be presented with a task (e.g., to cause a virtual character to retrieve food from refrigerator 36, cook it, and eat it), and the user may utilize the one or more actuators 82 to control animated image 62 (which may include one or more virtual characters such as first virtual character 64) to complete the task. In other embodiments, a user may use user interface 80 to cause a virtual character to interact with another virtual character.

User interface 80 may be operably connected to housing 12 via cable (as seen in FIGS. 1-5) or wireless connection. Additionally and/or alternatively, user interface 80 may be an integral part of housing 12.

Figure 4:
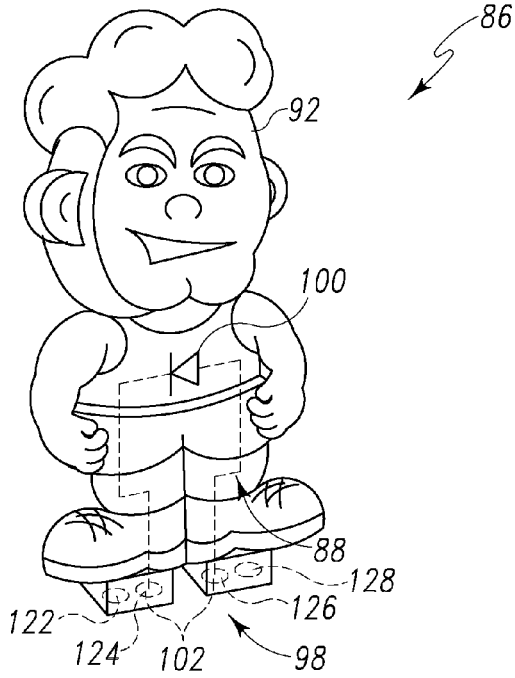
FIG. 4 depicts a removable toy in the form of a figurine.
Figure 5:
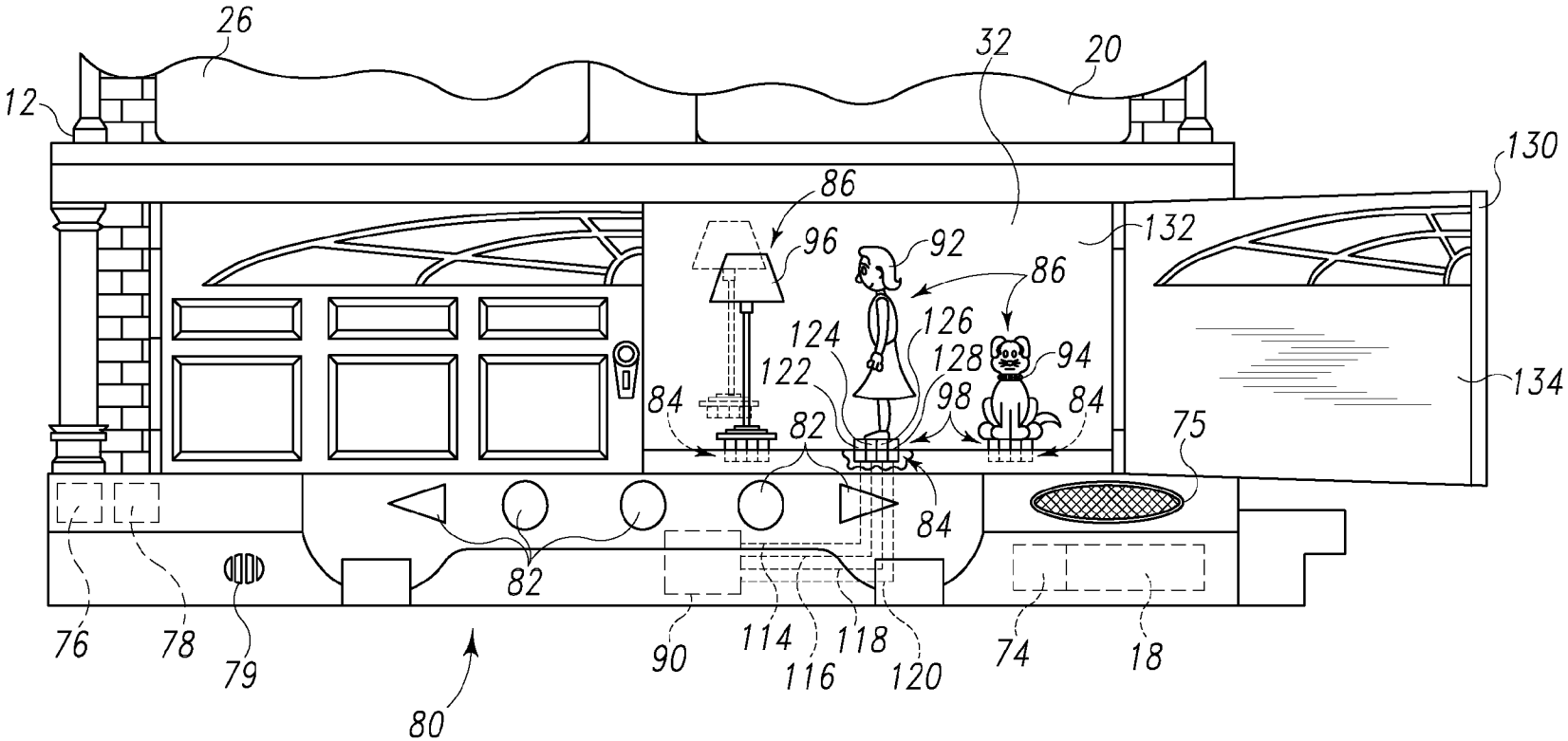
FIG. 5 depicts a receiving area located on a portion of the housing, the receiving area being configured to receive one or more removable toys such as the figurine of FIG. 4.
Figure 6:
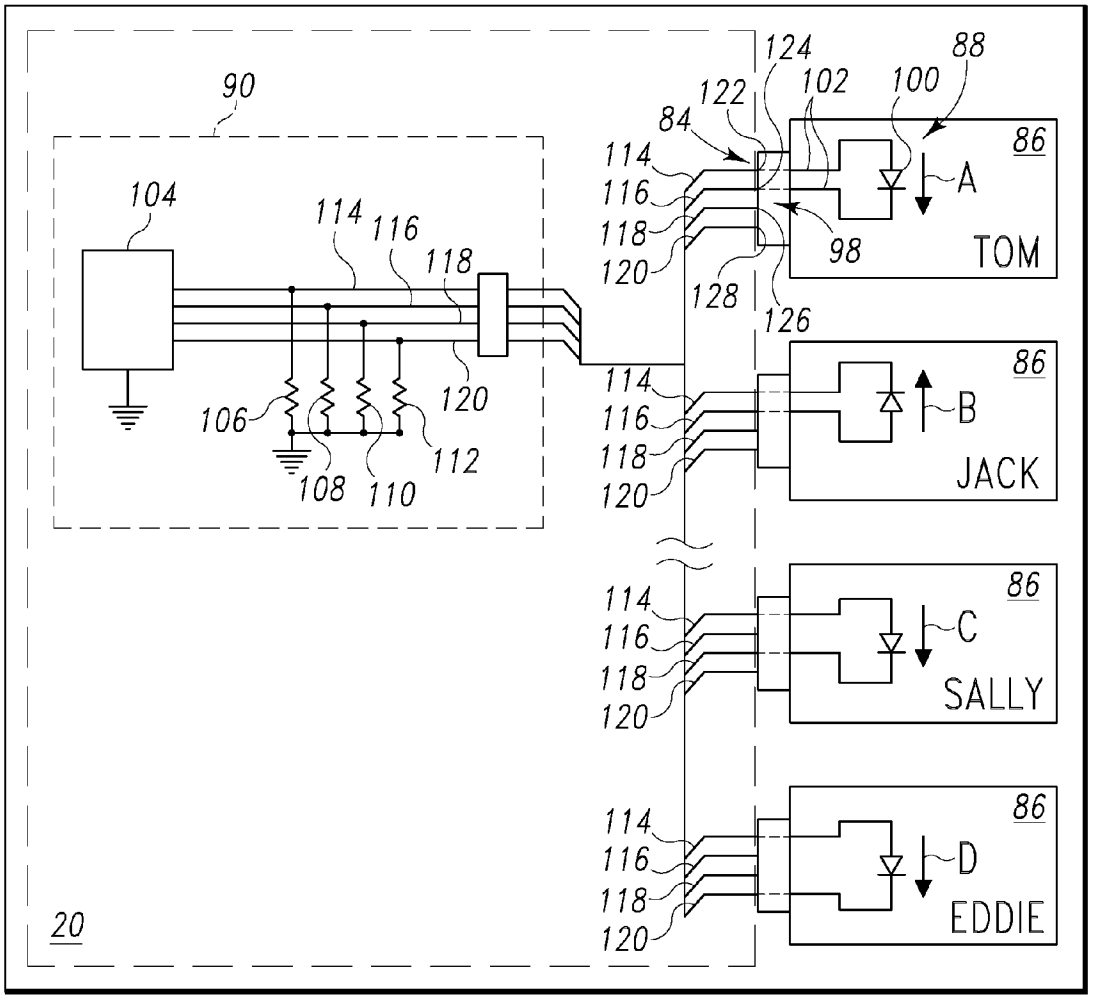
FIG. 6. depicts a schematic diagram illustrating an example circuit configured to allow housing to interact with one or more removable toys

Another aspect of the present disclosure provides for an electronic playset 10 configured to interact with foreign objects. Referring to FIGS. 4-6, electronic playset 10 may further comprise a first plurality 84 of electrical contacts disposed on housing 12, a removable toy 86 having an identifiable accessory 88, and a controller 90. In some examples, the first plurality 84 of electrical contacts may be disposed with receiving area 32. Identifiable accessory 88 of removable toy 86 may be connected to first plurality 84 of electrical contacts (i.e., removable toy 86 may be attached to housing 12). Once connected, controller 90 may be configured to interact with identifiable accessory 88 to determine an identity of removable toy 86. In some embodiments, controller 90 may pass this identity onto processor 18, which may in turn cause transparent screen 58 to display an animated image 62 including a first virtual character 64, based on the determined identity, superimposed over various regions.

While housing 12 may be similar to one of the multi-region embodiments described above, housing 12 with respect to this aspect of the present disclosure may take numerous other forms, such as a figurine, object or environment.

Removable toy 86 may take various forms such as a figurine 92, a creature 94, or an object 96. In embodiments where housing 12 takes a form different than the multi-region embodiments described above, removable toy 86 may resemble other objects. For instance, if housing 12 resembles a figurine, removable toy may resemble an article of clothing that may be affixed to housing 12, and housing 12 may "identify" the article of clothing. In embodiments where removable toy is a figurine such as 92, the first virtual character 64 may resemble the appearance of the figurine 92.

Identifiable accessory 88 may comprise a second plurality 98 of electrical contacts and diode 100. Second plurality 98 of electrical contacts may be connected to and removed from first plurality 84 of electrical contacts. A diode 100 may interconnect a first pair 102 of the second plurality 98 of electrical contacts, and diode 100 may be adapted to limit current flow between the first pair 102 of the second plurality 98 of electrical contacts to a first direction.

Controller 90 may be configured to determine an identity of removable toy 86 by interacting with identifiable accessory 88. Controller 90 may be electrically connected to the first plurality 84 of electrical contacts, as shown in FIGS. 3, 5 and 6. In some embodiments, controller 90 may be a subcomponent of processor 18. In other embodiments, controller 90 may be operably connected to and/or controlled by processor 18, as shown in FIG. 3. In yet other embodiments, controller 90 may be processor 18.

When second plurality 98 of electrical contacts is connected to first plurality 84 of electrical contacts (i.e., removable toy 86 is attached to housing 12), controller 90 may be configured to apply voltage to one of the first pair 102 of the second plurality 98 of electrical contacts. Controller 90 may then detect voltage on the other of the first pair 102 of the second plurality 98 of electrical contacts, and determine an identity of the removable toy 86 based at least in part on the first direction which diode 100 permits current to pass between the first pair 102 of the second plurality 98 of electrical contacts.

In addition to the first direction of current flow permitted by diode 100, controller 90 may detect other aspects of identifiable accessories 88, such as which electrical contacts are connected by diode 100. Second plurality 98 of electrical contacts may comprise three or more electrical contacts. Controller 90 may be further configured, in addition to the applying, detecting, and determining described above, to detect voltage on the one of the three or more electrical contacts not included in the first pair 102 of the second plurality 98 of electrical contacts, and to determine the identity of the removable toy 86 based on which two of the three or more electrical contacts form the first pair 102 of the second plurality 98 of electrical contacts. It further should be understood that more than three electrical contacts are possible, as is seen in the examples described below.

Particular examples shown in FIGS. 4-6 will now be described in detail. FIG. 6 depicts controller 90 having a logic unit 104, a first resistor 106, a second resistor 108, a third resistor 110, and a fourth resistor 112. First plurality 84 of electrical contacts comprises the ends of a first line 114, a second line 116, a third line 118, and a fourth line 120. First resistor 106 may be electrically connected to first line 114, second resistor 108 may be electrically connected to second line 116, third resistor 110 may be electrically connected to third line 118, and fourth resistor 112 may be electrically connected to fourth line 120.

In FIG. 6, a removable toy 86 labeled "TOM" is shown connected to first plurality 84 of electrical contacts. In this example, second plurality 98 of electrical contacts includes a first electrical contact 122, a second electrical contact 124, a third electrical contact 126, and a fourth electrical contact 128. First electrical contact 122 is shown connected to the end of line 114. Second electrical contact 124 is shown connected to the end of line 116. Third electrical contact 126 is shown connected to the end of line 118. And fourth electrical contact 128 is shown connected to end of line 120.

Diode 100 of the removable toy 86 labeled "TOM" is shown interconnecting the first 122 and second 124 electrical contacts, forming the first pair 102 of the second plurality of electrical contacts. Diode 100 may be adapted to limit current flow between the first 122 and second 124 electrical contacts in a first direction labeled A.

To determine an identity of removable toy 86, controller 90 may sequentially apply voltage to each line 114, 116, 118 and 120, and detect voltage on the resistors 106, 108, 110 and 112. For instance, controller 90 may apply voltage to first line 114, causing current to pass through first electrical contact 122 and diode 100 on the removable toy 86 labeled "TOM." The current causes second resistor 108 to have voltage. Controller 90 may detect this voltage and, using Table 1 below (which may be stored as a lookup table in, for instance, memory 74), determine that removable toy 86 having an identity of "TOM" is present.

TABLE 1

| | |
|---|---|
| Applying voltage to line 114 | |
| If resistor 108 has voltage | Removable toy 86 "TOM" is present |
| If resistor 110 has voltage | Removable toy 86 "SALLY" is present |
| If resistor 112 has voltage | Removable toy 86 "EDDIE" is present |
| Applying voltage to line 116 | |
| If resistor 106 has voltage | Removable toy 86 "JACK" is present |
| . . . | . . . |

Three other removable toys 86 also are shown in FIG. 6, labeled "JACK," "SALLY," and "EDDIE." Using Table 1 above, when controller 90 applies voltage to line 114, controller 90 may further detect voltage in resistor 110 (indicating that a removable toy 86 having an identity of "SALLY" is present) and resistor 112 (indicating that a removable toy 86 having an identity of "EDDIE" is present). Controller 90 may next apply voltage to line 116 and detect voltage in resistor 106 (indicating that "JACK" is present). Table 1 is meant to be illustrative; more variations of applying voltage to various lines and detecting voltage of various resistors are contemplated. It should be understood by one skilled in the art that more removable toys 86 having other diode 100/first pair 102 configurations are possible. For example, removable toys 86 having four electrical contacts with which to form first pair 102, in addition to diode 100 having two possible directions, provide for 12 different identifiable accessories 88, each capable of conveying a different identity:

$$\binom{4}{2} \text{ possible first pairs} \times 2 \text{ possible diode configurations} = 12$$

In some embodiments, controller 90 may be configured to identify removable toy 86 (i.e. perform the above-described steps of applying, detecting and determining) in response to second plurality 98 of electrical contacts (associated with a removable toy 86) being brought into contact with first plurality 84 of electrical contacts.

Other embodiments of playset 10 may comprise a user-controlled switch 130 operably connected to controller 90, which may be activated to cause controller 90 to perform the steps of applying, detecting and determining. For instance, some embodiments may include receiving area 32 resembling a garage 132 having one or more garage doors 134, wherein user-controlled switch 130 may be a portion of the garage door 134 which may be actuated when garage door 134 is closed.

FIG. 5 illustrates one way to utilize such an embodiment. A user may open garage door 134 to gain access to receiving area 32, which may include one or more first pluralities 84 of electrical contacts. The user may connect a second plurality 98 of electrical contacts associated with removable toy 86 (such as figurine 92, creature 94 or object 96) to one of the first pluralities 84 of electrical contacts in receiving area 32. FIG. 5 shows three removable toys 86, including a figurine 92, a creature 94, and an object 96, connected to three separate first pluralities 84 of electrical contacts in garage 132.

Controller 90 may await activation of user-controlled switch 130, such as a user closing garage door 134, to perform the steps of applying, detecting and determining described above. In other embodiments, controller 90 may await activation of user-controlled switch 130 comprising an actuator 82 on user interface 80 to perform the above-described steps of applying, detecting and determining.

Accordingly, while embodiments have been particularly shown and described with reference to the foregoing disclosure, many variations may be made therein. The foregoing embodiments are illustrative, and no single feature or element is essential to all possible combinations that may be used in a particular application. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate or imply a required or limited number of such elements, and do not indicate a particular position or order of such elements unless otherwise specifically stated.

What is claimed is:

1. An electronic playset comprising:

a housing including a first region and a second region;

a mount disposed on the housing;

a see-through electronic monitor coupled to the mount and moveable between a first position and a second position, the first position being adjacent to the first region and the second position being adjacent to the second region, the monitor including a transparent screen configured to display a first animated image superimposed over the first region when the monitor is in the first position, and to display a second animated image superimposed over the second region when the monitor is in the second position; and a light source disposed on the monitor and configured to illuminate the first region when the monitor is in the first position and to illuminate the second region when the monitor is in the second position.

2. The electronic playset of claim 1 wherein at least one of the first and second regions is a diorama with a three-dimensional object, and the transparent screen is further configured to display an animated image appearing to interact with the three-dimensional object.

3. The electronic playset of claim 1 further comprising:

a controller;

a first plurality of electrical contacts disposed on the housing and electrically connected to the controller; and a removable toy having an identifiable accessory comprising:

a second plurality of electrical contacts including a first pair of contacts;

a diode interconnecting the first pair of contacts and adapted to limit current flow between the first pair of contacts to a first direction;

wherein:

the second plurality of electrical contacts may be connected to the first plurality of electrical contacts; and the controller is configured to apply voltage to one contact that forms the first pair of contacts, to detect voltage on the other contact that forms the first pair of contacts, and to determine an identity of the removable toy based at least in part on the first direction.

4. The electronic playset of claim 3 wherein the second plurality of electrical contacts comprises a first electrical contact, a second electrical contact, and a third electrical contact, and the controller is further configured to detect voltage on the first, second or third electrical contact not included in the first pair of the second plurality of electrical contacts, and to determine the identity of the removable toy based on which two of the first, second and third electrical contacts form the first pair of the second plurality of electrical contacts.

5. The electronic playset of claim 3 wherein the controller is configured to perform the steps of applying, detecting and determining in response to the second plurality of electrical contacts being connected to the first plurality of electrical contacts.

6. The electronic playset of claim 3 further comprising a user-controlled switch operably connected to the controller, wherein the controller is configured to perform the steps of applying, detecting and determining in response to actuation of the user-controlled switch.

7. The electronic playset of claim 3 wherein at least one of the first and second animated images includes a character based on the identity of the removable toy.

8. An electronic playset comprising:

a housing including a first region, a second region and a third region;

a mount disposed on the housing; and a see-through monitor coupled to the mount so that the see-through monitor may be both rotated around and translated along the mount between a first position adjacent to the first region, a second position adjacent to the second region, and a third position adjacent to the third region, the see-through monitor including a transparent screen configured to display an animated image superimposed over the first region when the see-through monitor is in the first position, to display an animated image superimposed over the second region when the see-through monitor is in the second position, and to display an animated image superimposed over the third region when the see-through monitor is in the third position.

9. The electronic playset of claim 8 wherein the mount defines an axis and the first region is positioned on one side of the axis and the second and third regions are positioned on the opposite side of the axis.

10. The electronic playset of claim 8 wherein at least one of the first, second and third regions is a diorama with a three-dimensional object, and the transparent screen is further configured to display an animated image appearing to interact with the three-dimensional object.

11. The electronic playset of claim 8 further comprising:

a controller;

a first plurality of electrical contacts disposed on the housing and electrically connected to the controller; and a removable toy having an identifiable accessory comprising:

a second plurality of electrical contacts including a first pair of contacts;

a diode interconnecting the first pair of contacts and adapted to limit current flow between the first pair of contacts to a first direction;

wherein:

the second plurality of electrical contacts may be connected to the first plurality of electrical contacts; and the controller is configured to apply voltage to one contact that forms the first pair of contacts, to detect voltage on the other contact that forms the first pair of contacts, and to determine an identity of the removable toy based at least in part on the first direction.

12. The electronic playset of claim 11 wherein the second plurality of electrical contacts comprises a first electrical contact, a second electrical contact, and a third electrical contact, and the controller is further configured to detect voltage on the first, second or third electrical contact not included in the first pair of the second plurality of electrical contacts, and to determine the identity of the removable toy based on which two of the first, second and third electrical contacts form the first pair of the second plurality of electrical contacts.

13. The electronic playset of claim 11 wherein the controller is configured to perform the steps of applying, detecting and determining in response to the second plurality of electrical contacts being connected to the first plurality of electrical contacts.

14. The electronic playset of claim 11 further comprising a user-controlled switch operably connected to the controller, wherein the controller is configured to perform the steps of applying, detecting and determining in response to actuation of the user-controlled switch.

15. The electronic playset of claim 11 wherein the animated image includes a character based on the identity of the removable toy.

16. An electronic playset comprising:

a housing including a first region, a second region and a third region;

a mount disposed on the housing;

a see-through monitor coupled to the mount so that the see-through monitor may be both rotated around and translated along the mount between a first position adjacent to the first region, a second position adjacent to the second region, and a third position adjacent to the third region, the see-through monitor including a transparent screen configured to display an animated image superimposed over the first region when the see-through monitor is in the first position, to display an animated image superimposed over the second region when the see-through monitor is in the second position, and to display an animated image superimposed over the third region when the see-through monitor is in the third position; and a light source disposed on the see-through monitor and configured to illuminate the first region when the see-through monitor is in the first position, to illuminate the second region when the see-through monitor is in the second position, and to illuminate the third region when the see-through monitor is in the third position.

17. The electronic playset of claim 16 wherein the mount defines an axis and the first region is positioned on one side of the axis and the second and third regions are positioned on the opposite side of the axis.

18. The electronic playset of claim 16 wherein at least one of the first, second and third regions is a diorama with a three-dimensional object, and the transparent screen is further configured to display an animated image appearing to interact with the three-dimensional object.

19. The electronic playset of claim 16 further comprising:

a controller;

a plurality of electrical contacts disposed on the housing and electrically connected to the controller; and a removable toy having an identifiable accessory comprising:

a first electrical contact;

a second electrical contact;

a third electrical contact; and a diode interconnecting a first pair of contacts formed by two of the first, second and third electric contacts and adapted to limit current flow between the first pair of contacts to a first direction;

wherein:

the first, second and third electrical contacts may be connected to the plurality of electrical contacts; and the controller is configured to apply voltage to one contact that forms the first pair of contacts, to detect voltage on the other contact that forms the first pair of contacts, to detect voltage on the first, second or third electrical contact that does not form the first pair of contacts, and to determine an identity of the removable toy based at least in part on the first direction and on which two of the first, second and third electrical contacts form the first pair of contacts.

* * * * *